US005954020A

United States Patent [19]

Schmidt et al.

[11] Patent Number: 5,954,020

[45] Date of Patent: Sep. 21, 1999

[54] CUP-SHAPED TAPPET

[75] Inventors: Dieter Schmidt, Nuremberg; Walter Speil, Ingolstadt; Wolfgang Miereisz, Herzogenaurach; Karl Ludwig Grell, Aurachtal; Reinhard Ammon, Nuremberg, all of Germany

[73] Assignee: INA Walzlager Schaeffler KG, Germany

[21] Appl. No.: 08/765,034

[22] PCT Filed: Aug. 11, 1994

[86] PCT No.: PCT/EP94/02680

§ 371 Date: Jun. 9, 1997

§ 102(e) Date: Jun. 9, 1997

[87] PCT Pub. No.: WO95/06192

PCT Pub. Date: Mar. 2, 1995

[30] Foreign Application Priority Data

Aug. 24, 1993 [DE] Germany ..... 43 28 422

[51] Int. Cl.[6] ..... F01L 1/24; F01L 1/14

[52] U.S. Cl. ..... 123/90.48; 123/90.49; 123/90.51

[58] Field of Search ..... 123/90.48, 90.55, 123/90.49, 90.51; 29/888.03

[56] References Cited

U.S. PATENT DOCUMENTS

| | | | |
|---|---|---|---|
| 4,465,038 | 8/1984 | Speil | 123/90.55 |
| 4,602,409 | 7/1986 | Schnaeffler | 29/156.7 B |
| 4,702,406 | 10/1987 | Sullivan et al. | 228/200 |

FOREIGN PATENT DOCUMENTS

| | | |
|---|---|---|
| 0443146 | 8/1991 | European Pat. Off. . |
| 0496982 | 8/1992 | European Pat. Off. . |
| 2562157 | 10/1985 | France . |

*Primary Examiner*—Weilun Lo
*Assistant Examiner*—Arnold Castro
*Attorney, Agent, or Firm*—Bierman, Muserlian and Lucas

[57] ABSTRACT

A cup-shaped tappet (1) for actuating a gas exchange valve (17) of an internal combustion engine, comprising a cylindrical jacket (6) closed at one end by a bottom (7) and guided in a bore (2) of a cylinder head (3), the valve tappet (1) being actuated by a cam (4) of a camshaft (5) acting on the bottom (7) of the tappet (1) characterized in that the bottom (7) and the jacket (6) are steel components having respective wall thicknesses (A),(B) dimensioned so that a product ($P_1$) of the wall thicknesses, (A)×(B) expressed in millimeters is <2.3, the wall thickness (A) of the bottom (7) being 1.7 to 2.4 mm and the wall thickness (B) of the jacket (6) being 0.7 to 1.0 mm.

14 Claims, 3 Drawing Sheets

CUP-SHAPED TAPPET

The invention concerns a cup-shaped valve tappet for actuating a gas exchange valve of an internal combustion engine, comprising a cylindrical jacket closed at one end by a bottom and guided in a bore of a cylinder head, the valve tappet being actuated by a cam of a camshaft acting on the bottom of the tappet.

A cup-shaped valve tappet is for actuating a gas exchange valve (17) of an internal combustion engine, comprising a cylindrical jacket (6) closed at one end by a bottom (7) and guided in a bore (2) of a cylinder head (3), the valve tappet (1) being actuated by a cam (4) of a camshaft (5) acting on the bottom (7) of the tappet (1) is known from EP-A-00 30 781. This valve tappet comprises a hydraulic valve clearance compensation element lodged in a guide sleeve which is concentric with the jacket and extends from a web starting from the inner wall of the jacket. The bottom, the jacket and the web are all configured with relatively thick walls so that the valve tappet has a high overall weight. It is known that valve drives involving large masses require high spring forces for controlling their dynamics. However, these high spring forces lead to an increase of friction in the valve drive which results in higher fuel consumption. A further disadvantage of higher valve spring forces is the intensification of noises in the valve drive.

Efforts have therefore already been made in the past to reduce the weight of valve tappets by making them of a light-weight material such as aluminum, for example. However, such aluminum tappets require special measures for the configuration of the bottom because this is contacted by the cam of the camshaft usually made of steel. For this reason, the bottom was either provided with a wear-resistant layer, or it was made as a separate part of steel and fixed in the aluminum tappet. Such a configuration of a valve tappet is relatively expensive and not suitable for production in series.

The object of the invention is a considerable reduction of the weight of a valve tappet of the generic type by using simple means, so that friction in the valve drive and thus also fuel consumption of the internal combustion engine can be considerably reduced. At the same time, the valve drive must have an adequate rigidity for absorbing the valve actuating forces.

The invention achieves this object by the fact that the bottom and the jacket are steel components having wall thicknesses A, B dimensioned so that a product $P_1$ of the wall thicknesses, A×B, expressed in millimeters is ≦2.3, the wall thickness A of the bottom being 1.7 to 2.5 mm and the wall thickness B of the jacket being 0.7 to 1.0 mm. Hitherto, there existed reservations in the technical field regarding a further reduction of the wall thicknesses of valve tappets because it was feared that their rigidity would no longer be adequate. Calculations with the finite element method and test series have very clearly shown that the cup-shaped tappet of the invention, made preferably as a deep drawn part, has an adequate rigidity while the weight of the tappet is drastically reduced. Thus, the stated wall thickness ranges lie considerably below the wall thicknesses implemented in the past.

The cup-shaped tappet comprises a web starting from the jacket and merging into a guide sleeve which is concentric with the jacket and in which a hydraulic clearance compensation element is guided. The wall thickness C of the web made of a steel material is dimensioned so that a product $P_2$ of the wall thicknesses of the bottom, jacket and web, A×B×C, expressed in millimeters is ≦1.9, the wall thickness C of the web being 0.6 to 0.8 mm. Insofar as its rigidity proves to be inadequate, a thin-walled web of this type can be additionally supported, if necessary, by a sleeve extending up to the bottom and provided for enabling a suction of the oil supplied to the valve clearance compensation element at a lower level of the tappet (cf. DE-A-35 42 192). The use of such a thin-walled web likewise has a positive effect on a reduction of weight of the valve tappet.

The wall thicknsess of the jacket in an edge-proximate region below the web is reduced to form a collar having a wall thickness D. In this case, a product $P_3$ of the wall thicknesses of the bottom, jacket, web and collar, A×B×C×D expressed in millimeters is ≦1.48, the wall thickness D of the collar being 0.6 to 0.8 mm. The teachings of claims 1 to 7 permit an advantageous matching of the wall thicknesses of the bottom, jacket, web and collar to one another.

In a further development of the invention, an outer diameter E of the valve tappet bears the same ratio to the product $P_3$ of the wall thicknesses of the bottom, jacket, web and collar as 1 bears to a value that is ≦0.075. This ratio of the product $P_3$ to the outer diameter E which can also be expressed as ≦0.075, makes it clear that if the diameter of the valve tappet is reduced, the wall thicknesses can also be considerably reduced, and this does not result in a loss of rigidity.

A spring force F of a compression spring acting between a hollow piston and a pressure piston of the hydraulic clearance compensation element is ≦20 N when the pressure piston has receded completely into the hollow piston. Finally, the cross-sectional area G of a hollow piston of the hydraulic clearance compensation element is ≦1.1 $cm^2$. Due to the cross-section of the hollow piston and the pressure prevailing in the oil supply of the clearance compensation element as also due to the spring force F, a force opposing the valve spring force in the closed state of the gas exchange valve is created. If the valve spring force is to be reduced, these forces originating in the clearance compensation element must also be reduced. Therefore, according to the above-mentioned claims of the invention, both the spring force F and the cross-section of the hollow piston are minimized. Further, due to the small dimensions of the hydraulic clearance compensation element, it is also possible to reduce the inertia forces.

The end of the web adjacent to the jacket continues into a cylindrical portion which forms an interference fit with the inner surface of the jacket, has a length of ≧1 mm and is welded to the jacket, the weld seam depth being 0.6 to 0.8 mm. In this way, a through-welding with the consequent penetration of melted metal particles into the interior of the valve tappet is avoided.

The bottom and the jacket of the valve tappet are plated on their inner surfaces with a non-ferrous metal, which, is preferably nickel. This inner plating layer serves as a diffusion blocker so that during the carburizing process, only the outer operating surfaces of the cup-shaped tappet, i. e. the cup bottom and the cup jacket, are exposed to the carbon made available. A core hardening of the tappet with its familiar negative consequences is thus avoided.

It can be seen that the arm of the guide sleeve is welded or swaged to the jacket, the non-ferrous metal being utilized as an alloying agent or as a swaging material. To make welding at all possible, the arm of the guide sleeve must be in a soft state during the welding process. The plating layer has two functions in this connection. On the one hand, it must prevent a carburization of the jacket and the bottom of the cup from the inside, and on the other, it has to assure the weldability of the already hardened cup. This means that the plating layer serves as an alloying agent in the weld fusion zone and thus prevents an embrittlement of the weld seam since this retains its austenitic structure. If the arm of the guide sleeve is swaged into the cup jacket, it is of no importance whether this arm is hard or soft because the plating layer serves as a swaging material.

The arm of the guide sleeve is rolled into the jacket. In this case, the arm must be soft so that it is at all possible to roll it into the hardened, internally plated jacket.

In another embodiment of the invention, an embrittlement of the arm, web and guide sleeve during the hardening of the tappet is prevented by plating these parts at least on one side with a non-ferrous metal, or by making them of a low-hardening or an unhardenable material.

In this case too, the plating layer acts as a diffusion blocker for carbon in the manner described above so that a hardening of the arm, web and guide sleeve is prevented. An embrittlement of these parts is likewise prevented by making them of an unhardenable material, for example, an austenitic steel of the X 5 CrNi 18 10 type or of a low-hardening material of the St 4 type without hardenability-enhancing elements such as chromium, manganese, molybdenum or nickel.

Finally, in case the cup jacket and the arm of the guide sleeve are hardened, a ring of pure nickel is arranged in the location of the joint between the arm and the jacket, i.e. in the region of the weld seam to serve as a welding filler. A melting of the nickel during the welding process causes the base material to be alloyed to an extent that on solidification, a tough austenitic microstructure is obtained which prevents crack formation in the heat influenced zone.

The invention will now be further elucidated with reference to the drawings in which examples of embodiment of the cup-shaped valve tappet are shown in simplified form:

Figure 1:
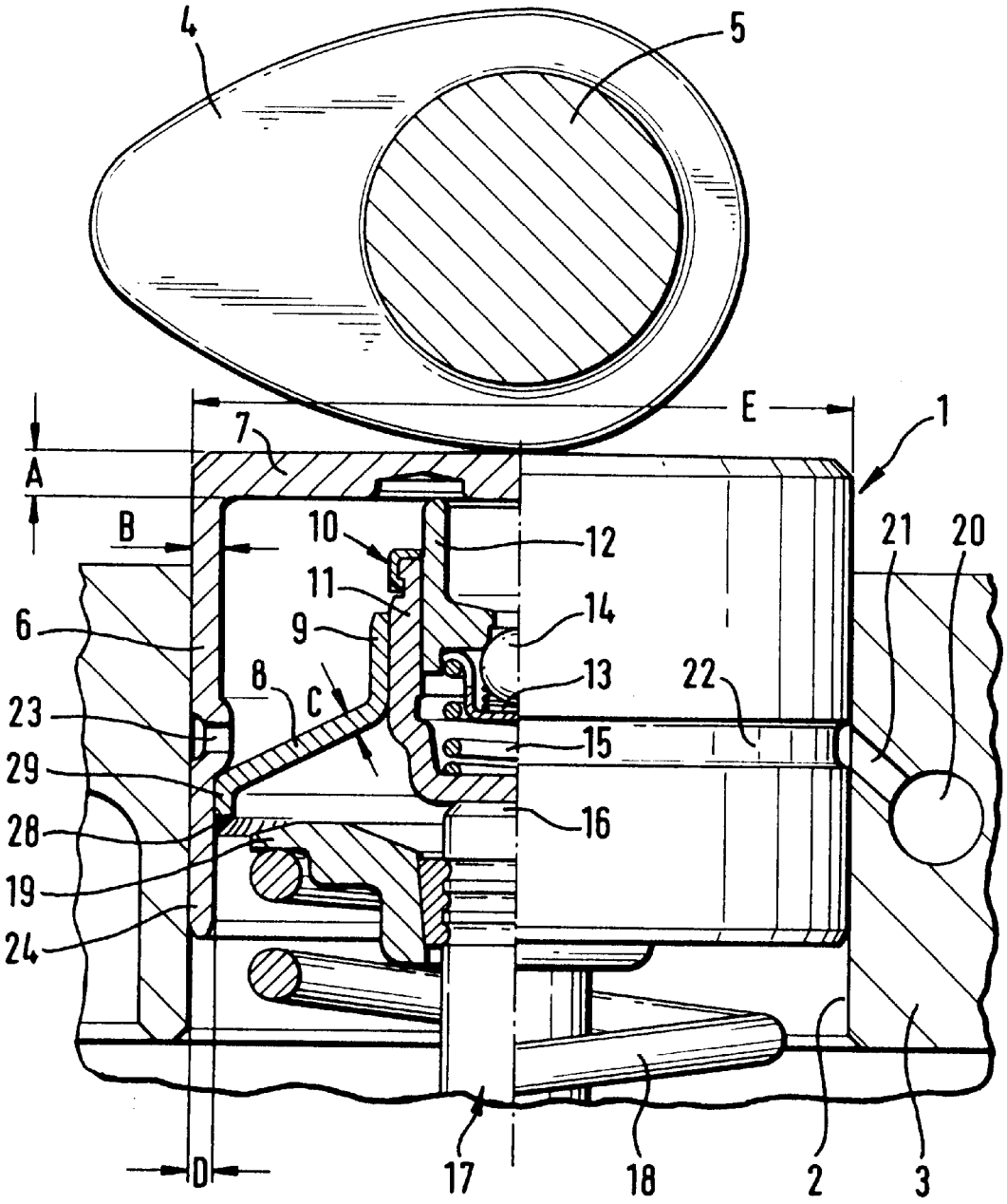
FIG. 1 is a semi-section through a valve tappet of the invention.
Figure 2:
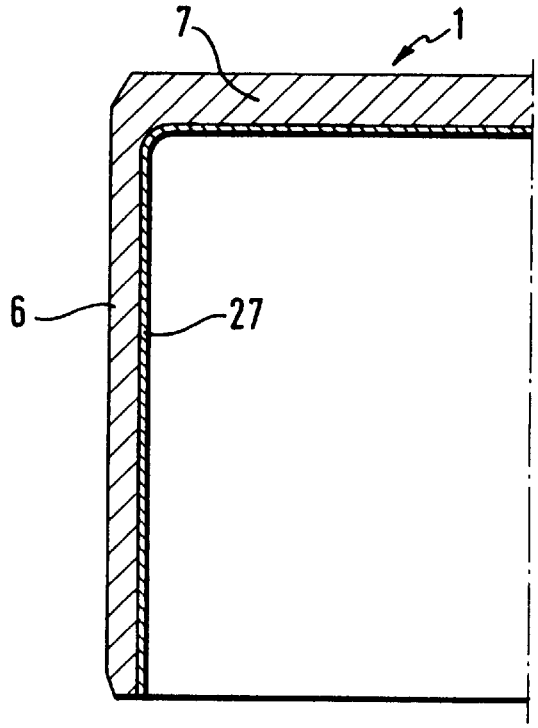
FIGS. 2 to 5 are semi-sections through various embodiments of the invention having plated inner surfaces and differently fixed guide sleeves.

The view of a valve tappet referenced at 1 in FIG. 1 includes a semi-section taken along its longitudinal axis. The tappet 1 is guided in a bore 2 of a cylinder head 3, only partly shown, and actuated by a cam 4 of a camshaft 5. The valve tappet 1 has a cup-shaped configuration including a cylindrical jacket 6 closed at one end by a bottom 7. The jacket 6 and the bottom 7 are preferably made as a one-piece component by deep drawing. Within the valve tappet 1, a web 8 in the shape of a funnel extends from the cylindrical jacket and merges at its end with a guide sleeve 9. This guide sleeve 9 is concentric with the jacket 6 and receives in its interior, a hydraulic clearance compensation element 10. This clearance compensation element 10 is comprised of a hollow piston 11, a pressure piston 12, a ball valve 14 biased in closing direction by a valve spring 13, and a compression spring 15 clamped between the hollow piston 11 and the pressure piston 12.

An end of the hollow piston 11 bears against an end 16 of a valve shaft of a gas exchange valve 17. A valve spring 18 of the gas exchange valve 17 is clamped between the cylinder head 3 and a spring retainer 19 connected to the end 16 of the valve shaft such that the valve spring 18 biases the gas exchange valve 17 in a closing direction.

The cylinder head 3 comprises a lubricating oil bore 20 from which extends an inclined channel 21 opening into the bore 2 which houses the valve tappet 1.

An annular groove 22 arranged on the outer peripheral surface of the cylindrical jacket 6 of the valve tappet 1 registers intermittently with the outlet of this channel 21. An oil inlet opening 23 leads from the annular groove 22 into the interior of the valve tappet. The funnel-shaped web 8, which, however, can also be M-shaped, comprises a cylindrical portion 29 with which the web 8 is pressed into the jacket 6 of the valve tappet 1. This cylindrical portion 29 is welded to the jacket 6 and, due to its overall axial length and a predefined weld seam depth of a weld seam 28, the cylindrical portion 29 prevents metal particles from penetrating into the interior of the valve tappet 1. The operation of the hydraulic clearance compensation element will not be discussed here because it forms the subject matter of numerous published patent applications, for example, also of the generic publication, EP-A-00 30 781.

The wall thickness of the bottom 7 is referenced at A and that of the jacket 6 at B, while the wall thickness of the web is referenced at C. Finally, the end of cylindrical jacket 6 facing away from the bottom 7 is narrowed down so as to form a collar 24 whose wall thickness is referenced at D.

The letter E stands for an outer diameter of the valve tappet 1, while a spring force of the compression spring 15 and the cross-sectional area of the hollow piston 11 are designated by the letters F and G respectively, which is the cross-sectional area.

$$G = \frac{G'}{2} 2 \cdot \pi$$

The invention enables the implementation of minimal wall thicknesses A, B, C and D which lead to a reduction of the total mass of the valve tappet and, in the final analysis, by reason of a reduction of the valve spring force, to a reduction of the valve actuating forces as well. Despite the small wall thicknesses, the valve tappet 1 possesses an adequate rigidity.

The valve tappets 1 shown in FIGS. 2 to 5 are plated on their inner surfaces in the region of the bottom 7 and the cylindrical jacket 6 with a covering metal 27, that is to say, the base metal and the covering metal 27 are firmly connected to each other by pressing or rolling. The covering metal 27 assures, in the manner already described above, that during thermochemical treating processes such as case hardening or nitrocarburizing, the diffusion elements, carbon, or carbon and nitrogen, are able to penetrate into the base metal only through the operating surfaces, i. e. through the outer surfaces of the bottom 7 and the jacket 6. A core hardening of the valve tappet with its known disadvantages is thus avoided. In the present embodiments, the valve tappet is made of a steel of the 16 MnCr 5 type, while the covering metal 27 is a nickel layer with a thickness of 0.05 to 0.2 mm.

Figure 3:
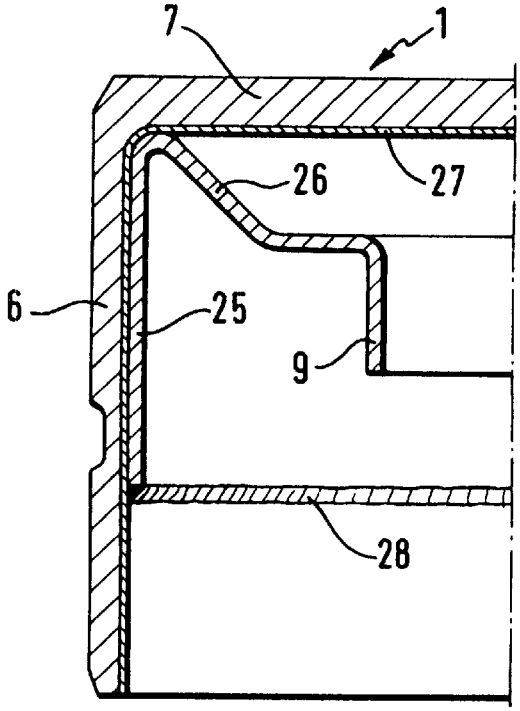
Figure 4:
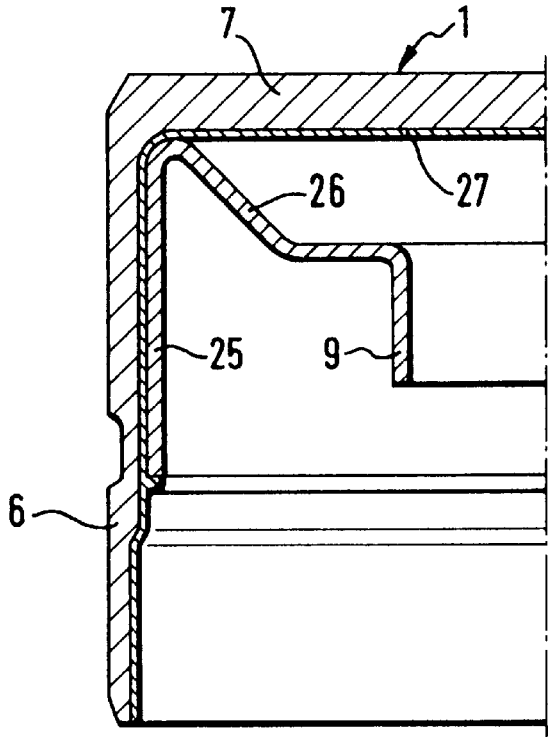
Figure 5:
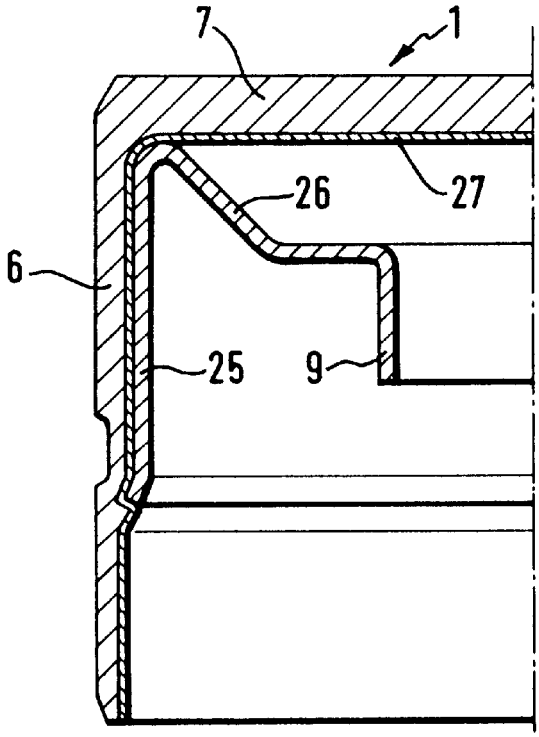

As can be seen from FIGS. 3 to 5, the clearance compensation element, not shown in these figures, is retained in the guide sleeve 9 which is connected via a web 26 with an arm 25 secured to the inner surface of the cylindrical jacket 6. In FIG. 3, the inner element comprised of the arm 25, the web 26 and the guide sleeve 9 is connected to the already hardened valve tappet 1 by a weld seam 28. This is only possible on condition that the inner element is inserted in a soft state, i.e. unhardened, into the tappet. According to FIG. 4, the hardened valve tappet 1 and the inner element are swaged to each other, with the covering metal 27 acting as a swaging material. In this case, the use of both a hardened or an unhardened inner element is possible. Finally, according to FIG. 5, the arm 25 is rolled into a groove, not referenced. Here again, it is appropriate to use an unhardened inner element.

We claim:

1. A cup-shaped tappet (1) for actuating a gas exchange valve (17) of an internal combustion engine, comprising a cylindrical jacket (6) closed at one end by a bottom (7) and guided in a bore (2) of a cylinder head (3), the valve tappet (1) being actuated by a cam (4) of a camshaft (5) acting on the bottom (7) of the tappet (1) characterized in that the bottom (7) and the jacket (6) are steel components having respective wall thicknesses (A), B dimensioned so that a product ($P_1$) of the wall thicknesses, (A)×(B) expressed in millimeters is ≦2.3, the wall thickness (A) of the bottom (7) being 1.7 to 2.4 mm and the wall thickness (B) of the jacket (6) being 0.7 to 1.0 mm.

2. A cup-shaped valve tappet (1) of claim 1 comprising a web (8) starting from the jacket (6) and merging into a guide sleeve (9) which is concentric with the jacket (6) and in which is guided a hydraulic clearance compensation element (10), characterized in that a wall thickness c of the web (8) made of a steel material is dimensioned so that a product ($P_2$)of the wall thicknesses of the bottom (7), jacket (6) and web (8), (A)×(B)×(C), expressed in millimeters is ≦1.9, the wall thickness (C) of the web (8) being 0.6 to 0.8 mm.

3. A cup-shaped valve tappet (1) of claim 2 comprising the jacket (6) whose wall thickness in an end-proximate region thereof situated below the web (8) is reduced to form a collar (24) having a wall thickness (D), characterized in that a product ($P_3$) of the wall thicknesses of the bottom (7), the jacket (6), web (8) and collar (24) expressed in millimeters (A)×(B)×(C)×(D), is ≦1.48, the wall thickness (C) of the web (8) being 0.6 to 0.8 mm and the wall thickness (D) of the collar (24) being 0.6 to 0.8 mm.

4. A cup-shaped valve tappet (1) of claim 3 wherein a quotient obtained by taking the product ($P_3$) as a dividend and an outer diameter, (E) of the valve tappet as a divisor is smaller than or equal to 0,075.

5. A cup-shaped valve tappet (1) of claim 1 wherein a spring force (F) of a compression spring (15) acting between a hollow piston (11) and a pressure piston (12) is ≦20 Newtons when the pressure piston (12) is in a completely receded position in a hollow piston (11).

6. A cup-shaped valve tappet (1) of claim 1 wherein a cross-sectional area (G) of a hollow piston (11) of a hydraulic clearance compensation element (10) is ≦1.1 $cm^2$.

7. A cup-shaped valve tappet (1) of claim 1 wherein an end of the web (8) adjacent to the jacket (6) continues into a cylindrical portion (29) which forms an interference fit with an inner surface of the jacket (6), has a length of ≧1 mm and is welded to the jacket (6) by a weld seam having a depth of 0.6 to 0.8 mm.

8. A cup-shaped valve tappet (1) of claim 1 wherein inner surfaces of the bottom (7) and the jacket (6) are plated with a non-ferrous metal (27).

9. A cup-shaped valve tappet (1) of claim 8 wherein the non-ferrous metal (27) is nickel.

10. A cup-shaped valve tappet (1) of claim 8 comprising an arm (25) which bears against the jacket (6) and continues into a web (26) which merges into a guide sleeve (9) which is concentric with the jacket (6) and in which is guided an hydraulic clearance compensation element (10), characterized in that the arm (25) of the guide sleeve (9) is welded or swaged to the jacket (6), the non-ferrous metal (27) being utilized as an alloying agent or as a swaging material.

11. A cup-shaped valve tappet (1) of claim 8 wherein an arm (25) of a guide sleeve (9) is rolled into the jacket (6).

12. A cup-shaped valve tappet (1) of claim 8 wherein an arm (25), a web (26) and a guide sleeve (9) are plated at least on one side with a non-ferrous metal (27).

13. A cup-shaped valve tappet (1) of claim 8 wherein an arm (25), a web (26) and a guide sleeve (9) are made of a low-hardening or an unhardenable material.

14. A cup-shaped valve tappet (1) of claim 10 wherein a ring of pure nickel serving as a weld filler material is arranged in a location of a joint between the arm (25) and the jacket (6).

* * * * *